US005288331A

United States Patent [19]

Rings et al.

[11] Patent Number: 5,288,331

[45] Date of Patent: Feb. 22, 1994

[54] METHOD FOR OPERATING A DISHWASHING MACHINE AND MAINTAINING THE ACTIVE OXYGEN CONTENT IN THE WASH TANK

[75] Inventors: Friedel Rings, Monheim; Karl-Heinz Odendahl, Grevenbroich; Horst Pruehs, Duesseldorf, all of Fed. Rep. of Germany

[73] Assignee: Henkel Kommanditgesellschaft auf Aktien, Duesseldorf, Fed. Rep. of Germany

[21] Appl. No.: 781,270

[22] PCT Filed: Jun. 15, 1990

[86] PCT No.: PCT/EP90/00944

§ 371 Date: Feb. 18, 1992

§ 102(e) Date: Feb. 18, 1992

[87] PCT Pub. No.: WO91/00044

PCT Pub. Date: Jan. 10, 1991

[30] Foreign Application Priority Data

Jun. 24, 1989 [DE] Fed. Rep. of Germany ..... 3920728

[51] Int. Cl.[5] ..... B08B 3/04; B08B 3/08

[52] U.S. Cl. ..... 134/25.2; 134/25.3; 134/18; 134/29; 134/93; 68/12.18; 68/17 R

[58] Field of Search ..... 134/25.2, 25.3, 18, 134/29, 93; 68/12.18, 17 R, 207; 222/63, 651

[56] References Cited

U.S. PATENT DOCUMENTS

| | | | |
|---|---|---|---|
| 3,133,673 | 5/1964 | Buss | 222/651 |
| 3,320,077 | 5/1967 | Morey | 68/12.18 |
| 3,370,597 | 2/1968 | Fox | 222/651 X |
| 4,373,863 | 2/1983 | Mason et al. | 417/12 |
| 4,622,161 | 11/1986 | Cornelissens et al. | 252/90 |
| 4,655,975 | 4/1987 | Snoble | 260/503 |
| 4,835,804 | 6/1989 | Arnau-Munoz et al. | 252/40 X |
| 5,014,211 | 5/1991 | Turner et al. | 68/17 R X |
| 5,068,937 | 12/1991 | Meloni et al. | 68/17 R X |

FOREIGN PATENT DOCUMENTS

| | | | |
|---|---|---|---|
| 2223217 | 4/1990 | United Kingdom | 222/63 |

*Primary Examiner*—Mark L. Bell
*Assistant Examiner*—Saeed T. Chaudhry
*Attorney, Agent, or Firm*—Ernest G. Szoke; Wayne C. Jaeschke; Kenneth Watov

[57] ABSTRACT

A dishwashing machine includes a washing tank for receiving wash water, and a detergent from a detergent dispensing system. A separate dosing system includes a tank for storing bleach, and a pump for supplying bleach from the bleach tank to the washing tank in measured quantities at predetermined times to maintain a desired active oxygen content therein over a complete cycle of operation.

21 Claims, 2 Drawing Sheets

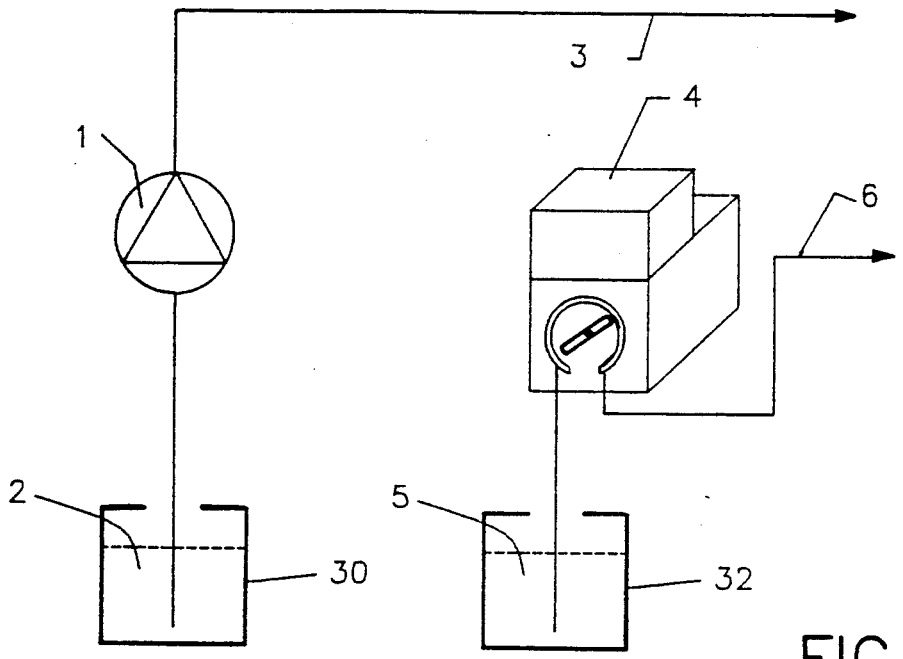
FIG. 1
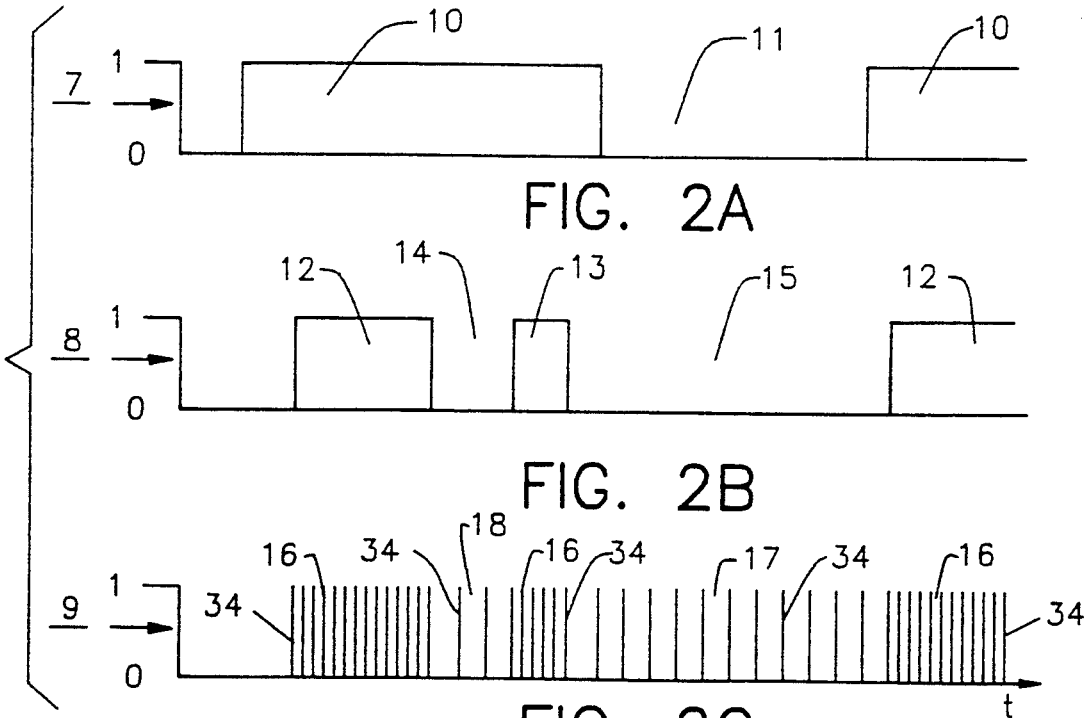
FIG. 2A
FIG. 2B
FIG. 2C

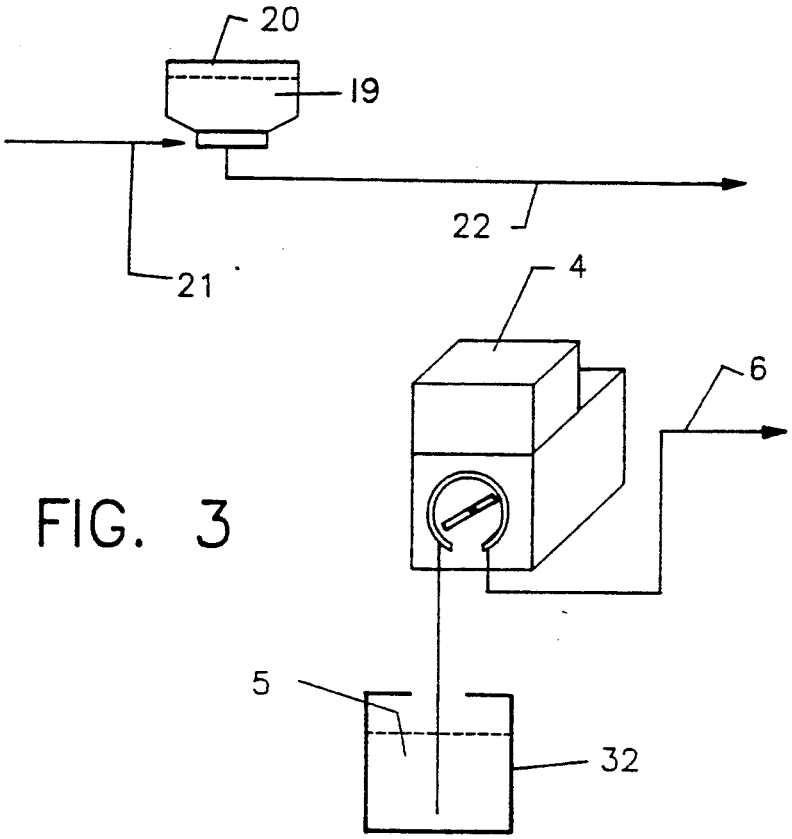
FIG. 3
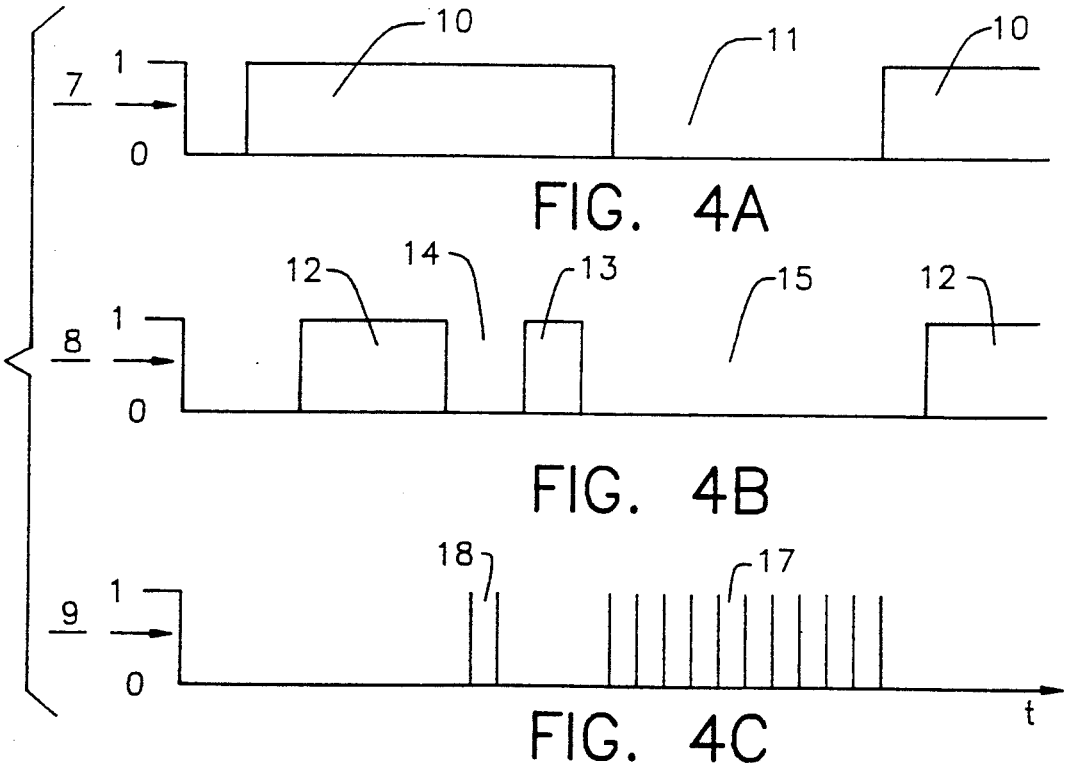
FIG. 4A
FIG. 4B
FIG. 4C

METHOD FOR OPERATING A DISHWASHING MACHINE AND MAINTAINING THE ACTIVE OXYGEN CONTENT IN THE WASH TANK

BACKGROUND 1.0 Field Of The Invention

This invention relates generally to dishwashing machines, and more particularly to methods and apparatus for supplying the washing tank of a dishwashing machine with chemical substances.

2.0 Discussion Of Related Art

In institutional dishwashing machines, with which the present invention is particularly concerned, fresh water is supplied to washing tank—also known as the dosing tank—in the clear-rinse phase. The corresponding quantity of detergent—controlled through conductivity—is subsequently added as required. Alkaline detergents of the described type used in practice contain active chlorine as their bleach component, mostly in the form of liquid chlorine bleach in the case of liquid detergents or in the form of di- and trichloroisocyanurates in the case of powder-form detergents.

The use of active chlorine as bleach in dishwashing machines is ecologically objectionable. As a result, efforts are being made to use environment-friendly bleaches. Considerable difficulties have been encountered in this regard. At the present time, only active oxygen is available as an economically reasonable alternative to active chlorine. However, this bleaching agent cannot be formulated with the generally highly alkaline liquid detergents.

Although solid active oxygen carriers can be incorporated in powder-form alkaline detergents, corresponding detergent formulations quickly lose their bleaching effect after flushing into the washing tank of the dishwashing machine because the active oxygen content of the rinse liquor quickly diminishes—often at around 40 to 60% per hour—during machine stoppage times. When a new rinse cycle begins, insufficient active oxygen is available in the washing tank so that cleaning performance can be unsatisfactory at the beginning of the rinse cycle.

EP-A-0 195 619 describes a method in which rinse cycles are carried out with a substance containing active oxygen after one or more wash cycles in a dishwashing machine comprising a spray unit.

In addition, U.S. Pat. No. 4,373,863 describes an apparatus for supplying the washing tank of a dishwashing machine with chemical substances which consist of a detergent dosing system for supplying detergent and a separate dosing system comprising a pump and a storage container for supplying another substance.

3.0 Summary Of The Invention

The problem addressed by the present invention was to enable active oxygen to be used as bleach in conjunction with an alkaline liquid detergent and to eliminate any significant reduction in the active oxygen content in the washing tank during pauses in dosing, even where a bleach-containing powder-form detergent is used. For the method mentioned at the beginning, the solution provided by the invention is characterized in that, where active oxygen is used as the bleach component, the active oxygen content in the washing tank is maintained during pauses in the dosing of detergent by maintenance dosing of the bleach. The maintenance dosing preferably takes place in individual dosing strokes.

Accordingly, one embodiment of the invention relates to maintenance dosing of the bleach during the stoppage times of the dishwashing machine between two successive rinse cycles. The effect of this maintenance dosing is that fresh bleach containing active oxygen enters the washing tank as the active oxygen content diminishes. Accordingly, the washing tank of the dishwashing machine is always kept in readiness for a new rinse phase and is therefore able immediately to supply dishwashing detergent containing sufficient bleach at the beginning of the rinse phase.

Another embodiment of the invention is characterized in that, where a detergent, particularly a powder-form detergent, basically containing sufficient bleach for immediate rinsing is used, bleach continues to be introduced into the washing tank as the active oxygen content decreases during the machine stoppage times or pauses in the dosing of detergent.

In addition to this maintenance dosing regime, a parallel bleach dosing regime is preferably provided in cases where a bleach-free detergent, particularly a liquid detergent, is used. According to another aspect of the invention, this means that, where a bleach-free detergent is used, bleach is introduced into the washing tank commensurately with detergent consumption during the rinse phases and commensurately with the reduction in the active oxygen content during the stoppage phases or the pauses in the dosing of detergent. Accordingly, the parallel dosing regime mentioned provides for the use of active oxygen carriers, such as for example hydrogen superoxide ($H_2O_2$) and/or peracetic acid solution, which cannot be formulated with the usual bleach-free alkaline detergents.

According to the foregoing, liquid or powder-form detergent is only introduced or flushed in during certain dosing times in dependence upon the conductivity control or the like, even during the rinse phases. If the corresponding intervals or the pauses in the dosing of detergent become so long that the active oxygen content decreases to the extent where the cleaning performance of the next rinse phase is impaired, bleach continues to be introduced, again by maintenance dosing, commensurately with the reduction in the active oxygen content, even in intermediate or standard pauses in the parallel dosing occurring during the rinse phases.

In another embodiment of the invention, the bleach input capacity of the maintenance dosing is optimized by determination of the active oxygen content. Once the rate of decomposition of the active oxygen is known, it can be sufficient if the bleach continues to be introduced at certain time intervals. In this connection, it is preferred to commence introduction of the bleach by maintenance dosing after the decomposition of about 20% of the active oxygen present.

In an apparatus for supplying the washing tank of a dishwashing machine with chemical substances, consisting of a detergent dosing system for supplying detergent and a separate dosing system comprising a pump and a storage container for supplying another substance, the solution provided by the invention is characterized in that the other dosing system is a bleach dosing system which has an operational mode for maintenance dosing which is activated during the pauses in the dosing of detergent.

The detergent dosing system may be designed in the usual way, i.e. as a dosing pump in the case of a liquid detergent or as a fresh water or liquor flush-in system in the case of a powder-form detergent. According to the invention, therefore, the only addition is the bleach dosing system separate from the detergent dosing system. This provides for parallel dosing at the same time as dosing of the bleach-free detergent and provides for maintenance dosing during the stoppage times of the dishwashing machine or the pauses in the dosing of detergent so that the consumption of active oxygen during such periods is compensated.

This auxiliary or maintenance dosing is necessary if, as is usually the case, the dishwashing machine is supplied with detergent via a control system which does not take the bleach content into account. This is because, in contrast to active oxygen, the concentration or quantity of detergent remains constant during the stoppage phases. Without the maintenance dosing of bleach, only detergent would be introduced into the washing tank at the beginning of the rinse phase commensurately with the inflow of fresh water. Accordingly, there would be a deficit of active oxygen and the outcome of the dishwashing process would be unsatisfactory, at least in regard to bleachable soil. According to the invention, these problems are overcome by the addition of a bleach dosing system.

According to the foregoing, there are in particular two possible embodiments of the invention, namely: (1) either the bleach dosing system has only one operating mode for maintenance dosing, i.e. when bleach-containing detergent is present, or (2) the bleach dosing system has an additional operating mode—functioning in parallel with the detergent dosing system—for parallel dosing when the detergent dosing system is switched on in cases where a bleach-free detergent is used. Accordingly, both bleach-containing and bleach-free detergent can be used, bleach only having to be introduced once during the entire period of operation of the dishwashing machine and, in the other case, only during the stoppage times between two rinse phases or only during dosing of the detergent. Essentially, parallel and maintenance dosing only differ in the bleach dose, i.e. in the quantity of active oxygen introduced into the washing tank per unit of time.

In another embodiment of the invention, a frequency-controlled peristaltic pump may be used for the parallel or maintenance dosing regime of the bleach dosing system. A pump of this type can be operated with a number of pump strokes per unit of time corresponding to the decomposition of active oxygen. For maintenance dosing, relatively few pump strokes are sufficient whereas a much larger number of pump strokes is necessary for parallel dosing where a bleach-free detergent is used. Accordingly, the associated frequency control of the pump preferably comprises a first control range for maintenance dosing and, optionally, a second control range for the rinse phase of the dishwashing machine—when the detergent dosing system is switched on—with a considerably increased input capacity in relation to the dose of the first control range.

BRIEF DESCRIPTION OF THE DRAWINGS

The invention is described in more detail in the following with reference to the accompanying drawings, in which similar items are identified by the same reference designation, wherein:

FIG. 1 is a block circuit diagram of a parallel and maintenance dosing system for bleaches of one embodiment of the invention.

FIGS. 2A, 2B, and 2C are each associated timing diagrams of the parallel and maintenance dosing system for bleaches in an institutional dishwashing machine of FIG. 1, respectively.

FIG. 3 is a block circuit diagram of a maintenance dosing system in a dishwashing machine supplied with powder-form detergent containing active oxygen in another embodiment of the invention.

FIGS. 4A, 4B and 4C are each associated timing diagrams of the detergent and active-substance supply system shown in FIG. 3, respectively.

FIG. 1 shows the liquid detergent and bleach supply section associated with an institutional dishwashing machine. A standard dosing pump 1 for liquid detergent pumps liquid detergent 2 from a liquid detergent tank 30, for example under the control of a conductivity measuring system, through a pipe 3 to a washing tank (not shown) of a dishwashing machine. Provided in parallel with the liquid detergent dosing pump 1 is a peristaltic pump 4 which delivers bleach 5 from a tank 32 containing active oxygen through a pipe 6 to the washing tank mentioned above. This additional parallel and maintenance dosing system for liquid active substances can be controlled by internal and external electronic circuitry in such a way that the functional diagram shown in FIG. 2 is obtained.

FIGS. 2A, 2B, and 2C show various "on" and "off" states (1/0) as a function of the time t in three lines 7, 8 and 9, respectively. The operational state of the dishwashing machine is symbolized in the uppermost line denoted by the reference 7 in FIG. 2A. The rinse phases or "on" states are denoted by the reference 10 while the stoppage phases or "off" states are denoted by the reference 11. The normal dosing of detergent, i.e. the operational state of the liquid detergent dosing pump 1, is represented by the second line denoted by the reference 8 in FIG. 2B. In the illustrated embodiment, it is assumed that the dosing pump 1 is activated twice during a machine "on" state 10 in dependence upon the conductivity of the detergent 2 accommodated in the washing tank of the dishwashing machine. The corresponding two detergent dosing phases are denoted by the references 12 and 13 in FIG. 2B. An intermediate interval is denoted by the reference 14 while the main pause corresponding to the "off" state 11 of the dishwashing machine is denoted by the reference 15. The additional dosing of active substance, i.e. the operational state of the peristaltic pump 4, is symbolized in the third line denoted by the reference 9 in FIG. 2C.

As shown in FIG. 2C, parallel dosing 16 with a rapid succession of individual pump strokes (shown as narrow pulses 34) of the peristaltic pump 4 is provided during the detergent dosing phases 12, 13 of the detergent dosing pump I. By contrast, the work of the peristaltic pump 4 is greatly reduced during the pauses 14, 15 in the operation of the dishwashing machine. In the corresponding maintenance dosing regime 17, there are considerably fewer pump strokes 34 per unit of time than during the parallel dosing regime in the rinse phases 10. It can be seen that liquid detergent 2 does not continue to be dosed during the stoppage phases 11 of the dishwashing machine. Nor is this necessary because there is no reduction in the quantity of detergent solution. Only the reduction in the active oxygen content during the stoppage phase 11 is compensated by the decelerated follow-up or maintenance dosing regime 17 in these phases. It can also be favorable to provide individual pump strokes 34 of a maintenance dosing regime 18 during relatively long intervals 14 between the rinse phases 10 of the dishwashing machine in order to compensate the continuing reduction in active oxygen during those intervals.

If the dishwashing detergent 2 already contains active oxygen, as is possible in the case of powder-form detergents, the parallel dosing regime according to the invention generally does not have to be provided, instead the maintenance dosing regime is sufficient. As shown in FIG. 3, the normal dosing of powder-form detergent 19 containing active oxygen takes place in a funnel 20 by fresh water or solution flush-in 21 and a pipe 22 leading to the washing tank of the dishwashing machine (arrowed direction).

In addition, as in FIG. 1, a bleach dosing system with a peristaltic pump 4 is provided in FIG. 3. The peristaltic pump 4 is designed to pump bleach 5 from a bleach tank 32 through a pipe 6 to the washing tank of the dishwashing machine. In contrast to FIG. 1, the peristaltic pump 4 shown in FIG. 3 only operates during the stoppage phases 11 of the dishwashing machine because, in the normal detergent dosing regime, the bleach 5 is dosed together with the detergent during the rinse phases 10. Only during an interval 14 between two normal dosings 12 and 13, as shown in FIGS. 4B and 4C, might it be favorable—similarly to the case of FIGS. 2B and 2C—to provide one or more of the dosing strokes 34 which form the maintenance dosing regime 18 during the stoppage phase 11 (see FIG. 4A) of the dishwashing machine.

A modification of a frequency-controlled peristaltic pump may advantageously be used to operate the maintenance dosing regime and the parallel dosing regime, if any. To this end, the frequency control system has two control ranges, namely a first range I for the parallel dosing regime 16 (see FIG. 2C) with a pump 4 output range of 8 to 290 ml/min. and a second range II for the maintenance dosing regime 17, 18 (see FIG. 4C) with a pump 4 output range of 1.5 to 3.5 ml/min. These two control ranges are designed to be externally selected to enable readjustments to be made in dependence upon the result of the dishwashing process.

LIST OF REFERENCE NUMERALS

1=dosing pump for liquid detergent
2=liquid detergent
3=liquid detergent pipe
4=peristaltic pump
5=bleach
6=bleach pipe
7=uppermost line (FIG. 2)
8=second line
9=third line
10=rinse phase
11=stoppage phase
12=detergent dosing time (1)
13=detergent dosing time (1)
14=interval (1)
15=main pause (1)
16=parallel dosing
17=maintenance dosing
18=maintenance dosing
19=powder-form detergent
20=funnel
21=flush-in of detergent by wash liquor
22 =pipe

What is claimed is:

1. A method for operating a dishwashing machine comprising a wash tank in which a detergent assisted or complemented in its effect by a bleach is introduced into the wash tank, wherein said method comprises the steps of:

including an active oxygen carrier in said bleach;

introducing a plurality of individual doses of detergent at different times into said wash tank, during predetermined phases of operation to maintain a desired level of detergent in said wash tank; and introducing doses of said bleach containing an active oxygen carrier into said wash tank at times that detergent is not being added to said wash tank, for maintaining the active oxygen content in said wash tank above a predetermined minimum level over rinse and stoppage phases of operation of said dishwashing machine.

2. A method as claimed in claim 1, wherein said oxygen maintaining step further includes said maintenance dosing being provided in individual dosing strokes.

3. A method as claimed in claim 2, wherein when a powder-form detergent containing sufficient bleach for immediate rinsing is used, said method further includes the step of continuing to introduce bleach into the washing tank as the active oxygen content decreases during machining stoppage phases or pauses in the dosing of detergent.

4. A method as claimed in claim 2, wherein when a bleach-free liquid detergent is used, said method further includes the step of introducing said bleach into the washing tank commensurately with detergent consumption during rinse phases and commensurately with the reduction in the active oxygen content during stoppage phases or pauses in the dosing of detergent.

5. A method as claimed in claim 2, wherein said maintenance step includes using hydrogen superoxide as the active oxygen carrier.

6. A method as claimed in claim 2, wherein said maintenance step includes using peracetic acid solution as the active oxygen carrier.

7. A method as claimed in claim 2, further including the steps of:

determining the rate of decomposition of the active oxygen in said wash tank; and calculating from the rate of decomposition of the active oxygen, time intervals at which doses of said bleach must be added to said wash tank to maintain the active oxygen content thereof above a predetermined level.

8. A method as claimed in claim 1, wherein when a powder-form detergent containing sufficient bleach for immediate rinsing is used, said method further includes the step of continuing to introduce bleach into the wash tank as the active oxygen content decreases during machining stoppage phases or pauses in the dosing of detergent.

9. A method as claimed in claim 8, further including the steps of:

determining the rate of decomposition of the active oxygen in said wash tank; and calculating from the rate of decomposition of the active oxygen, time intervals at which doses of said bleach must be added to said wash tank to maintain the active oxygen content thereof above a predetermined level.

10. A method as claimed in claim 1, wherein when a bleach-free liquid detergent is used, said method further includes the step of introducing said bleach in to the washing tank commensurately with detergent consumption during rinse phases, and commensurately with the reduction in the active oxygen content during stoppage phases or pauses in the dosing of detergent.

11. A method as claimed in claim 10, further including the steps of:

determining the rate of decomposition of the active oxygen in said wash tank; and calculating from the rate of decomposition of the active oxygen, time intervals at which doses of said bleach must be added to said wash tank to maintain the active oxygen content thereof above a predetermined level.

12. A method as claimed in claim 1, further including the steps of:

determining the rate of decomposition of the active oxygen in said wash tank; and calculating from the rate of decomposition of the active oxygen, time intervals at which doses of said bleach must be added to said wash tank to maintain the active oxygen content thereof above a predetermined level.

13. A method as claimed in claim 12, wherein the step of maintenance dosing of the bleach is commenced after a reduction of around 20% in the original active oxygen content.

14. An apparatus as claimed in claim 13, further including a frequency control system for said pump having means for providing a range of control over bleach doses for the maintenance dosing regime.

15. A method as claimed in claim 1, wherein said maintenance step includes using either one of hydrogen superoxide or peracetic acid solution as the active oxygen carrier.

16. A method as claimed in claim 1, wherein the step of maintenance dosing of the bleach is commenced after a reduction of around 20% in the original active oxygen content.

17. An apparatus for supplying the wash tank of a dishwashing machine with chemical substances, comprising a detergent dosing system for supplying detergent, a separate dosing system including a pump, and a storage container for supplying another substance, wherein said separate dosing system includes a bleach dosing system which includes means providing an operational mode for maintenance dosing of said bleach, which is activated during pauses in the dosing of detergent, for maintaining the active oxygen content in said wash tank over rinse and stoppage phases of operation of said dishwashing machine.

18. An apparatus as claimed in claim 17, wherein said bleach dosing system further includes means providing an operational mode functioning in parallel with said detergent dosing system for providing a parallel dosing regime when the detergent dosing system is on.

19. An apparatus as claimed in claim 18, wherein said pump includes a frequency-controlled peristaltic pump for pumping the bleach.

20. An apparatus as claimed in claim 17, wherein said pump includes a frequency-controlled peristaltic pump for pumping the bleach.

21. An apparatus as claimed in claim 20, further including a frequency control system for said pump having means for providing a range of control over bleach doses for the maintenance dosing regime.

* * * * *